US006695636B2

(12) United States Patent
Hall et al.

(10) Patent No.: US 6,695,636 B2
(45) Date of Patent: Feb. 24, 2004

(54) LOCKABLE ELECTRICAL CONNECTOR

(75) Inventors: John Wesley Hall, Harrisburg, PA (US); James Michael Raudenbush, Halifax, PA (US); Douglas John Hardy, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/056,669

(22) Filed: Jan. 23, 2002

(65) Prior Publication Data

US 2003/0139081 A1 Jul. 24, 2003

(51) Int. Cl.[7] ..... H01R 13/627
(52) U.S. Cl. ..... 439/352
(58) Field of Search ..... 439/352, 263, 439/675, 353, 350

(56) References Cited

U.S. PATENT DOCUMENTS 4,017,139 A * 4/1977 Nelson ..... 439/352
5,316,494 A * 5/1994 Flanagan et al. ..... 439/352
6,093,043 A * 7/2000 Gray et al. ..... 439/352
6,361,348 B1 * 3/2002 Hall et al. ..... 439/352

FOREIGN PATENT DOCUMENTS

EP 1 225 660 A2 7/2002

OTHER PUBLICATIONS

Tyco Electronics, *Coaxial Snap–Lock Connectors*, Application Specification No. 114–13010, Rev. B and C, 07/01 and 04/02.
AMP Incorporated, Part No. 1274223–1, *Sub–Assembly, Plug, Snap–Lock*, 10/98.
AMP Incorporated, Part No. 1274240–1 and 1274240–2, *PCB Jack, Snap–Lock*, 10/98.

* cited by examiner

*Primary Examiner*—Tho D. Ta

(57) ABSTRACT

A locking electrical connector is provided including a connector shell extending along a longitudinal axis, an outer contact held in the connector shell and having a mating end formed with retention beams that are deflectable radially outward from the longitudinal axis, and a collar located about the outer contact and the connector shell being slidable along the longitudinal axis relative to the connector shell between locked and unlocked positions. The collar has a blocking surface that is positioned to align with and block radially outward deflection of the retention beams when the collar is in the locked position. The blocking surface is moved, when the collar is in the unlocked position, to a position at which the collar permits radial outward deflection of the retention beams.

25 Claims, 8 Drawing Sheets

LOCKABLE ELECTRICAL CONNECTOR

BACKGROUND OF THE INVENTION

Certain embodiments of the present invention generally relate to a connector for maintaining electrical mating contact between electronic components. More particularly, certain embodiments of the present invention relate to a connector locking assembly for maintaining mating contact between an antenna and a conductive socket.

Many cars include radio antennas that are located on the roof of the car. The antenna typically is connected to, and delivers an electric signal to, a conductive socket located within the car between the roof of the car and a fabric headliner. The conductive socket extends through a hole in the roof to the antenna. The antenna and the conductive socket are secured to each other in mating contact by a connector locking assembly. The connector locking assembly is configured to be manually operated to release the antenna.

The typical connector locking assembly includes an outer contact, a dielectric, and a rear shell that are located on the car roof and centered over the hole. The outer contact is cylindrical and includes retention beams arranged concentrically around the dielectric, which is also cylindrical. Outer ends of the retention beams are bent to form a ring like rim that extends radially inward from main body of the retention beams. The antenna includes a base holding a connection jack that has a cylindrical wall with a receiving groove extending about a perimeter of the cylindrical wall. The receiving groove is arranged to receive the rim of the retention beams. The antenna is mounted to the connector locking assembly by inserting the cylindrical wall of the connection jack into a cylindrical chamber defined by the retention beams. The cylindrical walls of the connection jack have an outer diameter that is generally similar to the inner diameter of the rim of the retention beams, and thus the cylindrical walls cause the retention beams to expand circumferentially outward as the connection jack is inserted into the outer contact until the rim engages the receiving groove.

The conductive socket includes a body and a head, and both are situated within the dielectric, such that the head engages the connector jack when the connection jack is fully inserted into the outer contact. The antenna may be disengaged from the conductive socket by pulling the connection jack out of the outer contact.

The typical connector locking assembly suffers from certain drawbacks. The connection jack may be easily disengaged from the outer contact and thus lose electrical contact with the conductive socket. When the connection jack is positioned within the outer contact, the wall of the connection jack pushes the retention beams outward. Because the retention beams are constantly pushed outward when the connection jack is positioned within the outer contact, the retention beams may become permanently bent outward and thereafter only loosely retain the connection jack in contact with the conductive socket or even release the connection jack entirely from the outer contact.

Thus a need exists for a connector locking assembly that better retains the connection jack of the antenna and permits reliable repeated connection and disconnection.

BRIEF SUMMARY OF THE INVENTION

Certain embodiments provide a locking electrical connector that includes a connector shell extending along a longitudinal axis and an outer contact that is held in the connector shell with the outer contact having a mating end formed with retention beams that are deflectable radially outward from the longitudinal axis. The locking electrical connector also includes a collar that is located about the outer contact and the connector shell. The collar is slidable along the longitudinal axis relative to the connector shell between locked and unlocked positions. The collar has a blocking surface that is positioned to align with and block radially outward deflection of the retention beams when the collar is in the locked position. The blocking surface is moved, when the collar is in the unlocked position, to a position at which the collar permits radial outward deflection of the retention beams.

Certain embodiments also provide a locking coaxial connector that includes a shell extending along a longitudinal axis, inner and outer contacts held by the shell and arranged along the longitudinal axis, and a dielectric core held by the shell to separate the inner and outer contacts. The locking coaxial connector also includes a collar located about the outer contact. The collar is slidable along the longitudinal axis relative to the outer contact between locked and unlocked positions. The outer contact is movable in a radial direction transverse to the longitudinal axis. The collar encloses the outer contact when in the locked position to prevent radial outward movement of the outer contact and the collar exposes the outer contact to permit radial outward movement of the outer contact when the collar is in the unlocked position.

DETAILED DESCRIPTION OF THE INVENTION

Figure 1:
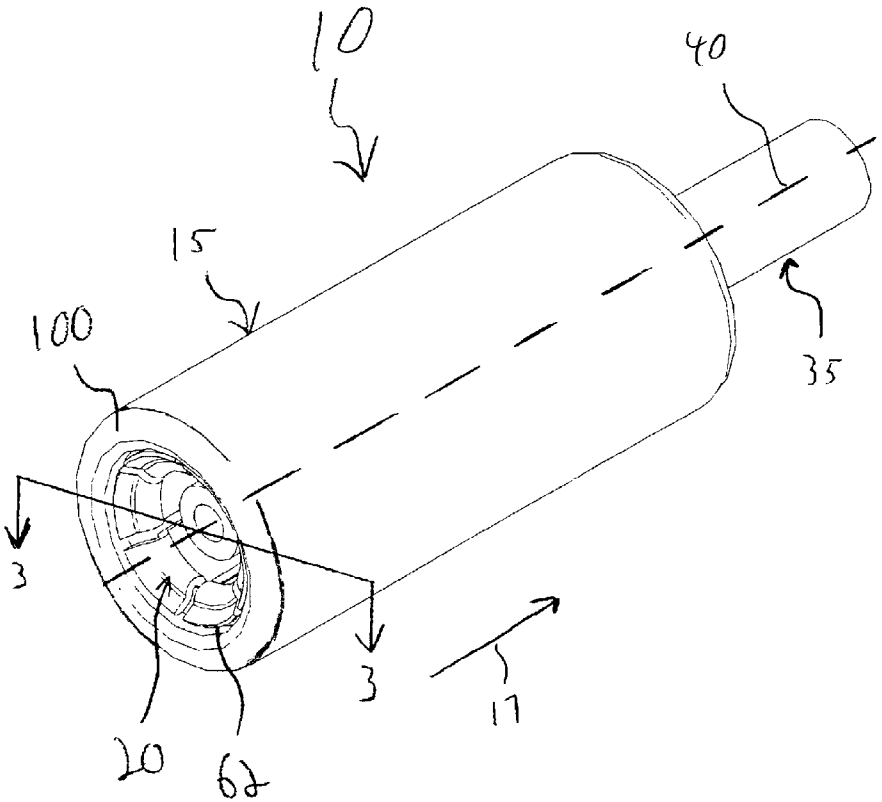
FIG. 1 illustrates an isometric view of a connector locking assembly in accordance with an embodiment of the present invention.

FIG. 1 illustrates an isometric view of a connector locking assembly 10 in accordance with an embodiment of the present invention. The connector locking assembly 10 includes a collar 15 having a generally cylindrical shape and aligned to extend along a longitudinal axis 40. The collar 15 encloses an outer contact 20 that is attached to a rear shell 35. The collar 15 is slidable in the direction of arrow 17 relative to the outer contact 20, such that as the collar 15 moves in the direction of arrow 17, a contact section 62 within the outer contact 20 projects beyond a rim 100 of the collar 15. In this manner, the outer contact 20 is exposed beyond the rim 100 of the collar 15 in order to facilitate engagement with a cylindrical mating jack as explained below in more detail.

Figure 2:
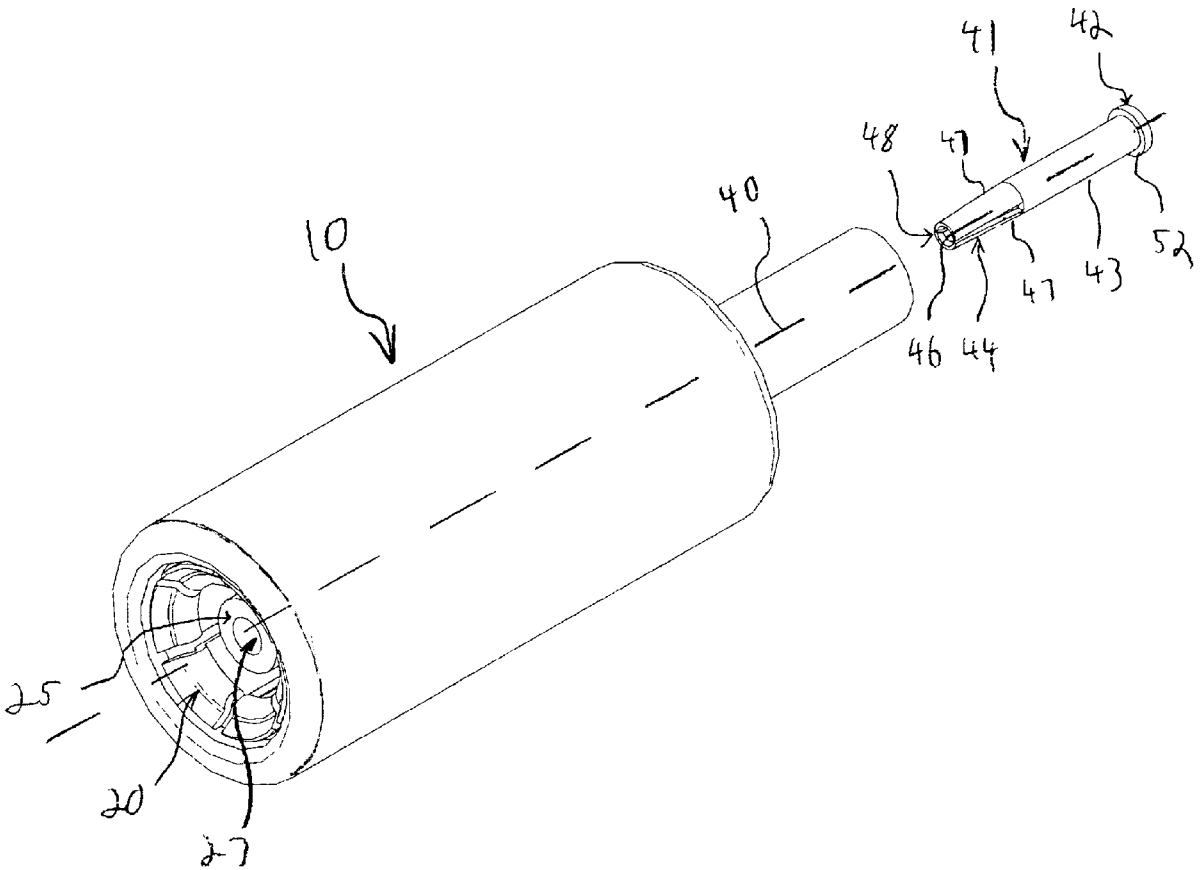
FIG. 2 illustrates an isometric view of the connector locking assembly of FIG. 1 and a center conductive socket according to an embodiment of the present invention.

FIG. 2 illustrates an isometric view of the connector locking assembly 10 of FIG. 1 and a center conductive socket 41. The outer contact 20 surrounds a tubular shaped dielectric core 25 that also extends along the longitudinal axis 40. The dielectric core 25 includes a hollow core 27 that receives the center conductive socket 41. The center conductive socket 41 is hollow and cylindrical and includes a securing base 42, an exterior wall 43, and a tapered contact head 44. The securing base 42 is formed integral with, and extends circumferentially outward from the exterior wall 43. The securing base 42 has an outer diameter greater than an outer diameter of the exterior wall 43 which forms a ring shaped retention wall 52. The securing base 42 and exterior wall 43 retain the center conductive socket 41 within the dielectric core 25 of FIGS. 1 and 2. The contact head 44 is secured to the exterior wall 43 opposite to the securing base 42 and tapers at an outer end 48 to a smaller outer diameter than the outer diameter of the exterior wall 43.

The outer end 48 of the contact head 44 includes a circular reception port 46 with an inner diameter formed by two tapered semi-cylindrical halves 47. The halves 47 contact each other proximate the outer end 48 and are separated by a triangular gap from each other proximate to an end joining the exterior wall 43. The halves 47 are bendable circumferentially outward. When the center conductive socket 41 is properly positioned into the dielectric core 25, the reception port 46 is aligned to receive a cylindrical contact portion (not shown) of the mating jack 145 (FIG. 6) that is removably insertable into the connector locking assembly 10. The contact portion has an outer diameter similar to the inner diameter of the reception port 46, in order that, as the contact portion enters the reception port 46, the contact portion pushes the halves 47 circumferentially outward. Because the center conductive socket 41 is secured within the dielectric core 25, the outward expansion of the halves 47 is limited and resisted by the dielectric core 25, and thus the dielectric core 25 holds the contact portion and the reception port 46 in electrical contact.

Figure 3:
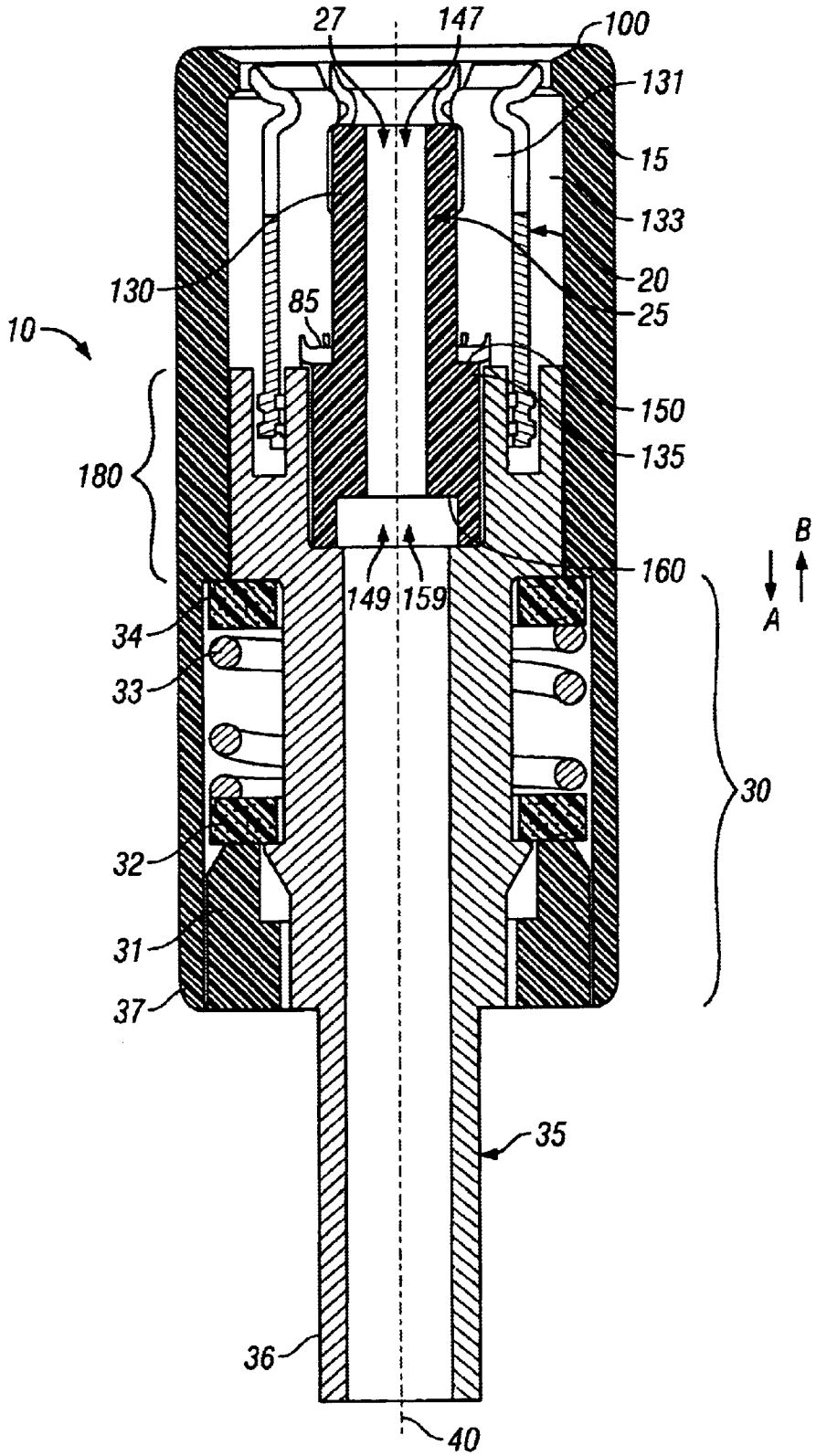
FIG. 3 illustrates a side sectional view taken along line 3—3 in FIG. 1 of the connector locking assembly.
Figure 6:
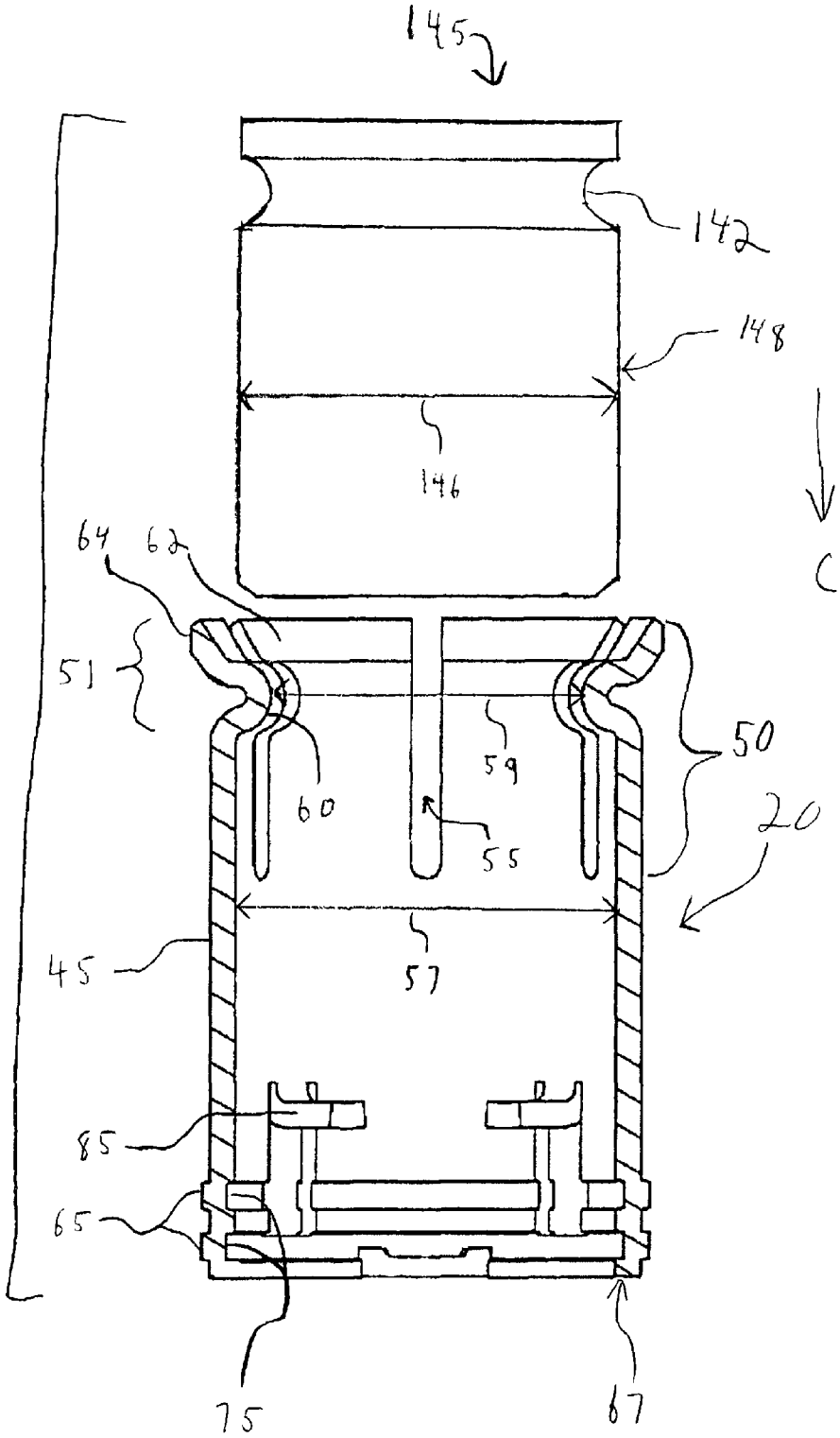
FIG. 6 illustrates a side sectional view of the outer contact taken along line 6—6 in FIG. 5 and a mating jack according to an embodiment of the present invention.
Figure 7:
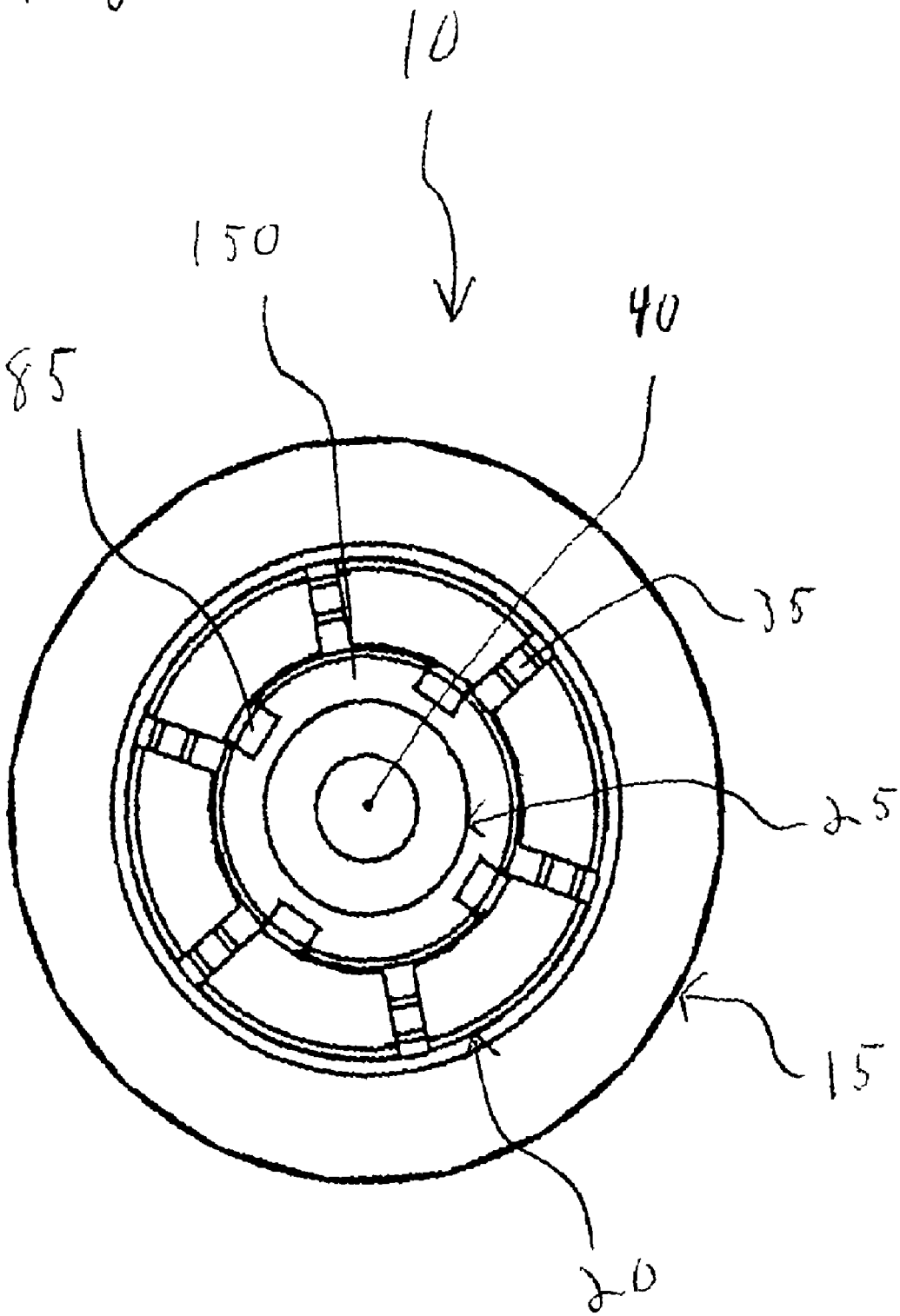
FIG. 7 illustrates a front view of the connector locking assembly of FIG. 1.

FIG. 3 illustrates a side sectional view taken along line 3—3 in FIG. 1 of the connector locking assembly 10, while FIG. 7 illustrates a front view of the connector locking assembly 10 of FIG. 1. The various elements and components of FIG. 3 are illustrated separately and in more detail in the subsequent FIGS. 4–8. The connector locking assembly 10 generally includes the collar 15 that encloses the outer contact 20 which in turn encloses the dielectric core 25 arranged concentrically within the outer contact 20 and along the longitudinal axis 40. The hollow core 27 extends along a length of the dielectric core 25.

The collar 15 partially encloses the rear shell 35 while a rear end 36 of the rear shell 35 extends beyond a rear end 37 of the collar 15. The rear shell 35 includes a contact capture section 180 that partially receives the outer contact 20 and the dielectric core 25. An intermediate portion of the rear shell 35 is surrounded by a spring retention assembly 30 including a spring 33, washers 32 and 34, and a locking collar 31. Opposite ends of the spring 33 are held between the washers 32 and 34. The locking collar 31 fits within the rear end 37 of the collar 15 to hold the washer 32 and the spring 33 within the rear end 37 of the collar 15.

During operation, a user grips the collar 15 and the rear shell 35 and induces relative motion therebetween by sliding the collar 15 in the direction of arrow A relative to the rear shell 35. As the collar 15 moves, the outer contact 20 is exposed beyond the rim 100 to facilitate connection with the mating jack 145 (FIG. 6) described below. As the collar 15 moves in the direction of arrow A relative to the rear shell 35, washers 32 and 34 are biased toward one another, thereby compressing the spring 33. Once the mating jack 145 (FIG. 6) is inserted into the connector locking assembly 10, the collar 15 is released and the spring 33 expands to force the washer 34 in the direction of arrow B relative to the washer 32. As the spring 33 expands, it similarly drives the collar 15 forward in the direction of arrow B until returning to an initial state at which the outer contact 20 is entirely enclosed within the collar 15.

Figure 4:
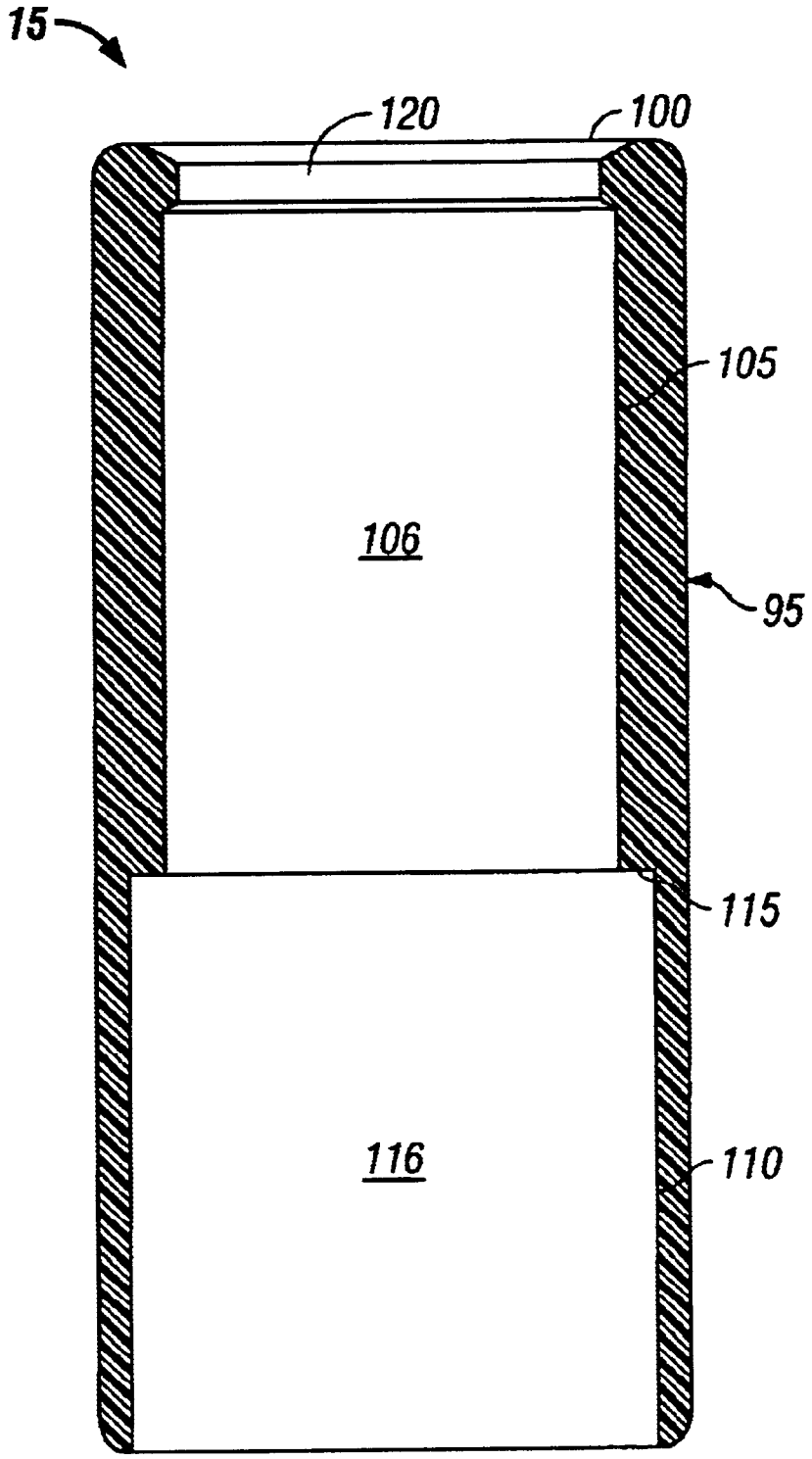
FIG. 4 illustrates a side sectional view of the collar of FIG. 1 in more detail.
Figure 8:
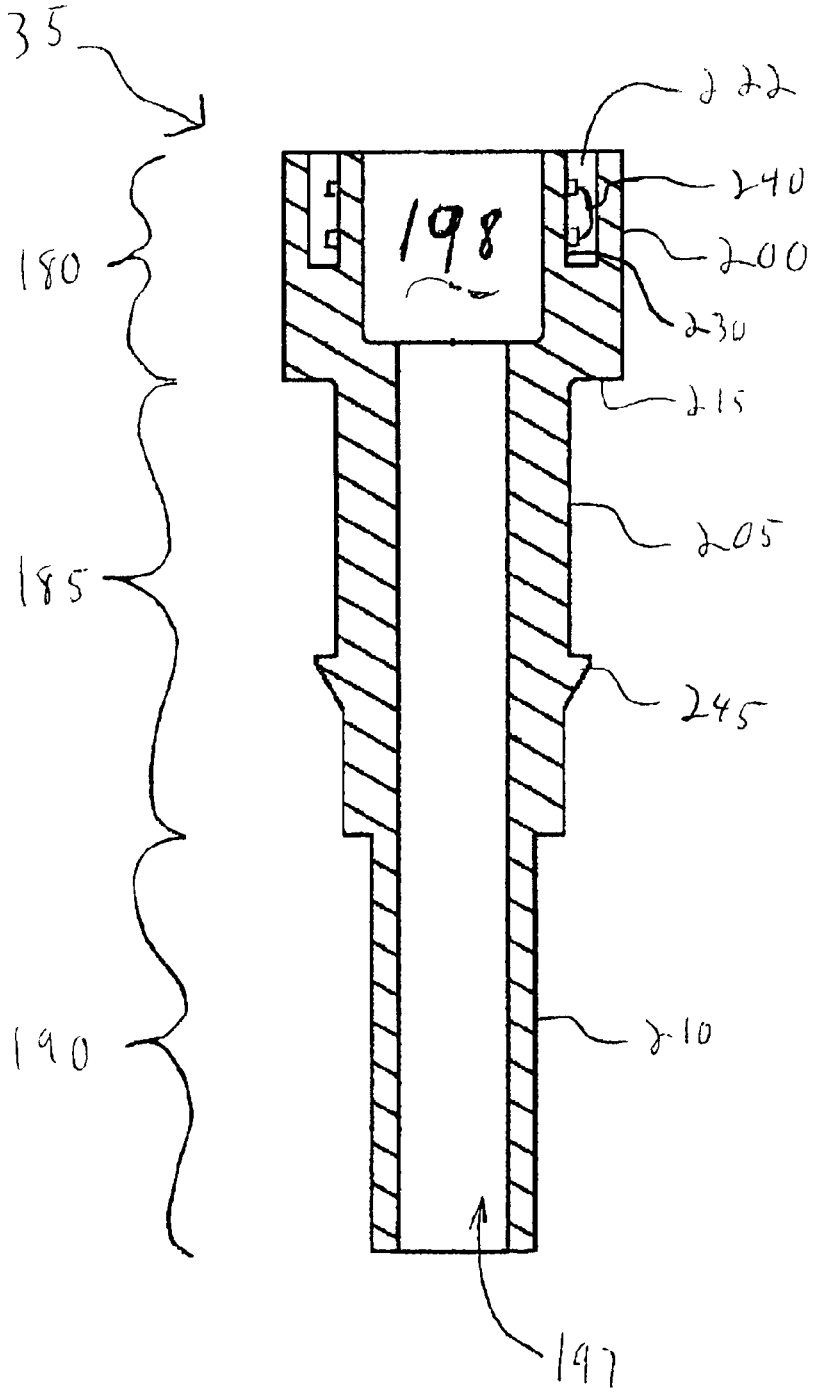
FIG. 8 illustrates a side sectional view of the rear shell of FIG. 1.

FIG. 4 illustrates a side sectional view of the collar 15 of FIG. 1 in more detail. The collar 15 is generally cylindrical and includes a sleeve 95 having the rim 100. The sleeve 95 includes chambers 106 and 116 having different diameters defined by interior surfaces 105 and 110 of the sleeve 95. The interior surface 105 joins the interior surface 110 at a ledge 115 that extends radially from the interior surface 105 to the interior surface 110. The interior surface 105 encircles and contacts a portion of the rear shell 35 (FIGS. 1, 3, and 8). The chamber 106 receives the outer contact 20 (shown in detail in FIGS. 5 and 6). The chamber 116 encircles and retains the rear shell 35 and the spring retention assembly 30 of FIG. 3. The locking collar 31 of the spring retention assembly 30 is welded to the interior surface 110 and the spring retention assembly 30 extends along the interior surface 110 from a second end to the ledge 115, which engages and resists the washer 34. As an operator slides the collar 15 in the direction of arrow A in FIG. 3, the interior surface 105 slides along the rear shell 35. As the collar 15 slides in the direction of arrow A, the ledge 115 pushes, and is resisted by, the spring retention assembly 30, and the outer contact 20 is exposed. The exposed outer contact 20 is free to expand circumferentially outward while receiving or releasing the mating jack 145 (FIG. 6).

With continued reference to FIG. 4, the rim 100 is formed integral with, and extends radially inward from, the sleeve 95. The rim 100 has a diameter smaller than an inner diameter of the interior surface 105 that defines a ring shaped contact surface 120. The contact surface 120 engages the outer contact 20 and resists the circumferentially outward expansion of the outer contact 20 when the collar 15 is in its final locked position.

Figure 5:
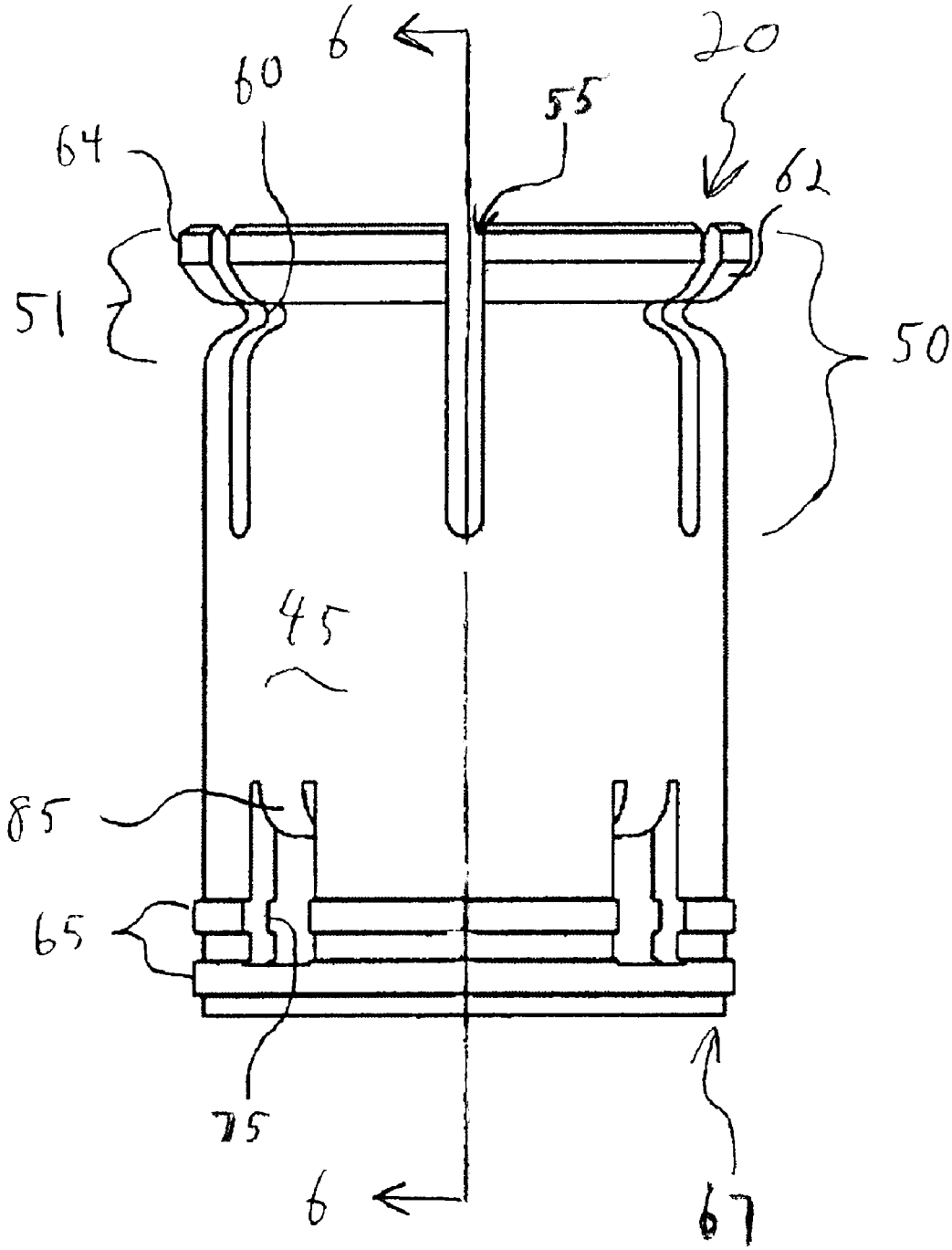
FIG. 5 illustrates a side view of the outer contact of FIG. 1.

FIG. 5 illustrates a side view of the outer contact 20 of FIG. 1, while FIG. 6 illustrates a side sectional view of the outer contact 20 taken along line 6—6 in FIG. 5 and a mating jack 145. The outer contact 20 is generally cylindrical and includes a wall 45 having integral curved retention beams 50 at one end thereof. The retention beams 50 are separated from each other by gaps 55 and are aligned in a ring. The retention beams 50 share a first inner diameter 57 (FIG. 5) with the wall 45 that is generally similar to an outer diameter 146 measured about a wall 148 of the mating jack 145. The retention beams 50 have a retention portion 51 that is crimped radially inward about the perimeter of the wall 45 to form a securing ridge 60. The securing ridge 60 forms a second smaller inner diameter 59 (FIG. 5) within the outer contact 20. The securing ridge 60 is configured to fit into a groove 142 about the perimeter of the mating jack 145. Because the retention beams 50 are aligned cylindrically and separated by the gaps 55, the retention beams 50 may be biased circumferentially outward when exposed beyond the rim 100 of the collar 15 (FIGS. 1 and 4). Therefore, when the collar 15 is slidably moved in the direction of arrow A (FIG. 3) exposing the outer contact 20, the mating jack 145 may be inserted into the outer contact 20 in the direction of arrow C with the wall 148 of the mating jack 145 engaging and pushing the securing ridge 60, and thus the retention beams 50, radially outward until the groove 142 and the securing ridge 60 engage one another. The retention beams 50 then return to an unbiased position, and the collar 15 is slidably positioned back over the outer contact 20 in order that the rim 100 holds the retention beams 50 radially inward.

The retention beams 50 define the rectangular contact section 62 that is flared outward from the securing ridge 60 beyond the outer diameter of the wall 45. The contact section 62 assists alignment with a lead end of the mating jack 145 during mating. The contact section 62 includes a stop pad 64 that faces radially outward and extends about the perimeter of the contact section 62. When the rim 100 is positioned in a locking position around the outer contact 20, the stop pad 64 engages the contact surface 120 of the collar 15 (FIG. 4). Thus, once the mating jack 145 is retained within the outer contact 20, when the wall 148 of the mating jack 145 attempts to push the retention beams 50 circumferentially outward, the contact surface 120 of the collar 15 engages and resists movement of the retention beams 50, holding the retention beams 50 inward and preventing the mating jack from disengaging from the outer contact 20.

The wall 45 includes two ring-like protrusions 65 and two corresponding interior cavities 75 proximate a rear end 67 of the wall 45. The protrusions 65 wrap around and extend circumferentially outward and inward from the wall 45. The interior cavities 75 catch and hold the rear shell 35 (FIGS. 1, 3, and 8), thereby retaining the outer contact 20 on the rear shell 35.

The wall 45 also includes rectangular retention tabs 85 that are formed integrally with, and are bent radially inward from, the wall 45. The retention tabs 85 are perpendicular to the wall 45 and retain the dielectric core 25 (FIG. 3) within the rear shell 35.

Returning to FIGS. 3 and 7, the dielectric core 25 is non-conductive and generally cylindrical in shape. The hollow core 27 has opposed open ends 147 and 149. The dielectric core 25 is formed in a staged manner with a thin wall portion 130 and a thick wall portion 135. The thin wall portion 130 has a smaller outer diameter than the thick wall portion 135. The thin and thick wall portions 130 and 135 join at a ring shaped retention ledge 150 that extends in a radial direction. The end 149 of the hollow core 27 opens into a longer chamber 159 to form a socket retention wall 160 about the end 149.

The dielectric core 25 is positioned within the collar 15 with the thick wall portion 135 encircled by, and retained within, the rear shell 35 and the thin wall portion 130 suspended concentrically within, and spaced apart from, the outer contact 20. A space 131 is provided between the thin wall portion 130 and the outer contact 20. A space 133 is provided between the outer contact 20 and the collar 15. The retention tabs 85 of the outer contact 20 engage and retain the retention ledge 150 of the dielectric core 25, thus holding the thick wall portion 135 within the rear shell 35.

The dielectric core 25 retains the center conductive socket 41 of FIG. 3 within the connector locking assembly 10. The exterior wall 43 and the contact head 44 of the center conductive socket 41 are enclosed within the thin wall portion 130. The securing base 42 of the center conductive socket 41 is generally the shape of, and may be retained within, the chamber 159 with the retention wall 52 of the center conductive socket 41 engaging the socket retention wall 160 of the dielectric core 25. In operation, the dielectric core 25 receives the contact portion (not shown) of the mating jack 145 (FIG. 6) through the end 147 as the mating jack 145 is removably inserted into the connector locking assembly 10 in the direction of arrow A. When the mating jack 145 is fully inserted into the connector locking assembly 10, the contact portion is received by, and in electrical contact with, the contact head 44 of the center conductive socket 41.

FIG. 8 illustrates a side sectional view of the rear shell 35 of FIG. 1. The rear shell 35 includes the cylindrical contact capture section 180 that joins a cylindrical body section 185 that joins a cylindrical recessed section 190. The rear shell 35 includes a passageway 197 extending therebetween. The passageway 197 opens at one end into a chamber 198. The contact capture section 180, the body section 185, and the recessed section 190 have different decreasing outer diameters about first, second, and third exterior walls 200, 205, and 210, respectively. A ring shaped retention wall 215 is provided at the intersection between the second exterior wall 205 and the first exterior wall 200. The retention wall 215 is aligned along the ledge 115 of the collar 15 (FIG. 4) and resists movement of the washer 34 in the direction of arrow B (FIG. 3).

The contact capture section 180 also includes a cylindrical recess 222 arranged concentrically between the first exterior wall 200 and the chamber 198. The recess 222 includes two ring shaped retention protrusions 240 that are formed integral with, and extend outward from an inner recess surface 230. The retention protrusions 240 are similar in size to the interior cavities 75 of the outer contact 20 of FIGS. 5 and 6. The outer contact 20 is positioned within the recess 222 with the interior cavities 75 engaging and retaining the retention protrusions 240, holding the outer contact 20 within the recess 222 of the rear shell 35 (as shown in FIG. 3).

The body section 185 includes a triangular retention barb 245 that is formed integral with, and extends circumferentially outward from, the second exterior wall 205 so as to have a greater outer diameter than the second exterior wall 205. The retention barb 245 engages the washer 32, and thus retains the spring retention assembly 30 against the retention wall 215 (FIG. 3). The retention barb 245 also prevents the locking collar 31 from sliding along the second exterior wall 205 in the direction of arrow B (FIG. 3) and thus maintains the collar 15 appropriately positioned around the outer contact 20.

The recessed section 190 is generally tube shaped and extends downward through a roof (not shown) of a car to a headliner (not shown) of a car. The recessed section 190 is positioned through the roof so that a gap exists between the roof and the body section 185, allowing the collar 15 to be slidably positioned in the direction of arrow A without the rear end 37 of the collar 15 (FIG. 3) contacting the roof. The center conductive socket 41 of FIG. 2 is slidably positioned inside the passageway 197 of the recessed section 190 and the body section 185 into the hollow core 27 of the dielectric core 25 (FIG. 3). The center conductive socket 41 may include other electronic components (not shown) that extend from the center conductive socket 41 through the passageway 197 and into the headliner of the car.

The connector locking assembly 10 confers several benefits. First, the collar 15 encircles and secures the retention beams 50 of the outer contact 20 so that the retention beams 50 do not expand circumferentially outward when retaining the mating jack 145. Therefore, the mating jack 145 may not easily be disengaged from the outer contact 20. Secondly, the connector locking assembly 10 utilizes a spring-and-washer based spring retention assembly 30. The spring retention assembly 30 allows for the collar 15 to be slidably positioned to expose the outer contact 20 for receiving or releasing the mating jack 145, and the spring retention assembly 30 also maintains the unbiased collar 15 securely around the outer contact 20.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A lockable electrical connector comprising:

a connector shell extending along a longitudinal axis, said connector shell including a contact capture section proximate a front end and a body section, said body section having an outer diameter that is different from and smaller than an outer diameter of said contact capture section;

an outer contact held in said contact capture section of said connector shell, said outer contact having a mating end formed with retention beams that are deflectable radially outward from said longitudinal axis, said retention beams being configured to receive a mating jack;

a collar mounted over said outer contact and said connector shell, said collar being slidable along said longitudinal axis relative to said outer contact between locked and unlocked positions, said collar having a blocking surface positioned to surround and block outward radial deflection of said retention beams from said longitudinal axis when said collar is in said locked position, said blocking surface being moved, when said collar is in said unlocked position, to a position at which said collar permits outward radial deflection of said retention beams thereby being adapted to receive a mating jack; and a spring mounted within a chamber in said collar, said spring surrounding said body section of said connector shell, said spring biasing said collar in said locked position relative to said outer contact, said spring being loaded onto said body section over a rear end of said connector shell, said rear end being located opposite to said front end.

2. The lockable electrical connector of claim 1, wherein said connector shell includes a contact capture section on one end, said contact capture section including a center chamber surrounded by a ring-shaped recess, said center chamber and said ring-shaped recess opening onto one end of said connector shell, said center chamber receiving a dielectric core, said ring-shaped recess receiving an end of said outer contact opposite to said deflection beams, said dielectric core being arranged concentrically within said outer contact.

3. The lockable electrical connector of claim 1, wherein each of said retention beams has an end portion flared outward radially from said longitudinal axis to define stop surfaces that face outward about a perimeter of said outer contact, said stop surfaces aligning with and abutting against said blocking surface when said collar is in aid locked position.

4. The lockable electrical connector of claim 1, wherein said collar includes an interior rim extending inward toward said longitudinal axis to define said blocking surface, said blocking surface having an interior diameter that is smaller than an interior diameter of said collar.

5. The lockable electrical connector of claim 1, further comprising a tubular-shaped dielectric core held in said connector shell, said dielectric core including a hollow passage extending therethrough and aligned along said longitudinal axis, said dielectric core receiving an inner contact, said inner and outer contacts and dielectric core being arranged concentric with one another.

6. The lockable electrical connector of claim 1, wherein said retention beams are separated from one another by gaps and are aligned in a ring about said longitudinal axis, said retention beams including retention portions crimped radially inward to form securing ridges, said securing ridges having an inner diameter that is smaller than an inner diameter of said outer contact.

7. The lockable electrical connector of claim 1, wherein said mating end of said outer contact extends beyond an outer end of said collar when said collar is in said unlocked position.

8. The locking connector of claim 1, further comprising a spring retention assembly biasing said collar into said locked position relative to said outer contact, said spring retention assembly including a spring mounted about said connector shell, washers located at opposite ends of said spring, and a locking collar securely fitted within a rear end of said collar to retain said washers and said spring between said collar and said connector shell.

9. The lockable electrical connector of claim 1, wherein said connector shell is surrounded by at least one of said spring, at least one washer, and a locking collar.

10. The lockable electrical connector of claim 1, wherein said chamber includes a ledge pushing against said spring.

11. A locking connector matable in a coaxial cable jack comprising:

a shell extending along a longitudinal axis, said shell including a contact capture section proximate a front end and a body section, said body section having an outer diameter that is different from and smaller than an outer diameter of said contact capture section;

inner and outer contacts held by said shell to align concentric with one another along said longitudinal axis;

a dielectric core held by said shell between said inner and outer contacts;

a collar located about said outer contact, said collar being movable relative to said outer contact along said longitudinal axis between locked and unlocked positions, said outer contact being movable in a transverse direction to said longitudinal axis, said collar enclosing said outer contact when in said locked position to prevent movement of said outer contact, in said transverse direction wherein at least a portion of said outer contact is exposed beyond an end of said collar, when said collar is in said unlocked position, to permit radial outward movement of said outer contact; and a spring mounted between said shell and said collar, said spring surrounding said body section of said shell, said spring biasing said collar and said shell into said locked position, said spring being loaded onto said body section over a rear end of said connector shell, said rear end being located opposite to said front end.

12. The locking connector of claim 11, wherein said shell includes a contact capture section including a chamber opening onto an end of said shell, said chamber securely receiving one end of said dielectric core.

13. The locking connector of claim 11, wherein said shell includes a contact capture section having a ring-shaped recess located about said longitudinal axis, said ring-shaped recess opening onto one end of said contact shell, said ring-shaped recess securely retaining an end of said outer contact.

14. The locking connector of claim 11, wherein said outer contact includes retention beams formed on a mating end of said outer contact, said retention beams being deflectable radially outward from said longitudinal axis, thereby being adapted to accept a mating contact therein.

15. The locking connector of claim 11, further comprising a spring retention assembly biasing said collar into said locked position relative to said shell, said spring retention assembly including a spring mounted about said shell, washers located at opposite ends of said spring, and a locking collar securely fitted within a rear end of said collar to retain said washers and said spring between said collar and said shell.

16. The locking connector of claim 11, wherein said connector shell is surrounded by at least one of said spring, at least one washer, and a locking collar.

17. The locking connector of claim 11, wherein said chamber includes a ledge pushing against said spring.

18. A locking electrical connector comprising:

a connector shell extending along a longitudinal axis, said connector shell including a contact capture section proximate a front end and a body section, said body section having an outer diameter that is different from and smaller than an outer diameter of said contact capture section;

an outer contact held in said connector shell, said outer contact having a mating end formed with retention beams that are deflectable outward radially from said longitudinal axis;

a collar located about said outer contact and said connector shell, said collar being slidable along said longitudinal axis relative to said connector shell between locked and unlocked positions, said collar having a blocking surface that is positioned to align with and block radially outward deflection of said retention beams when said collar is in said locked position, said blocking surface being moved, when said collar is in said unlocked position, to a position at which said collar permits radial outward deflection of said retention beams; and a spring retention assembly mounted between said collar and said connector shell, said spring retention assembly surrounding said body section of said connector shell, said spring retention assembly biasing said collar into said locked position relative to said connector shell, said spring retention assembly being loaded onto said body section over a rear end of said connector shell, said rear end being located opposite to said front end.

19. The locking electrical connector of claim 18, wherein said connector shell includes a contact capture section on one end, said contact capture section including a center chamber surrounded by a ring-shaped recess, said center chamber and said ring-shaped recess opening onto one end of said connector shell, said center chamber receiving a dielectric core, said ring-shaped recess receiving an end of said outer contact opposite to said deflection beams.

20. The locking electrical connector of claim 18, wherein each of said retention beams has an end portion that is flared radially outward to define stop surfaces that face outward about a perimeter of said outer contact, said stop surfaces aligned with and abutting against said blocking surface when said collar is in said locked position.

21. The locking electrical connector of claim 18, wherein said collar includes an interior rim containing said blocking surface, said blocking surface having an interior diameter that is smaller than an interior diameter of said collar.

22. The locking electrical connector of claim 18, wherein said spring is mounted about a body section of said connector shell and held within said collar, said spring biasing said collar into said locked position relative to said connector shell.

23. The locking electrical connector of claim 18, wherein said spring retention assembly includes a spring mounted about said connector shell, washers located at opposite ends of said spring, and a locking collar securely fitted within a rear end of said collar to retain said washers and said spring between said collar and said connector shell.

24. The locking electrical connector of claim 18, wherein said connector shell is surrounded by at least one of said spring, at least one washer, and a locking collar.

25. The locking electrical connector of claim 18, wherein said collar includes a chamber retaining said spring, said chamber having a ledge pushing said spring.

* * * * *